US005706733A

United States Patent [19]

Bichler

[11] Patent Number: 5,706,733

[45] Date of Patent: Jan. 13, 1998

[54] PROCESS FOR PRINTING THERMOPLASTIC MATERIALS

[75] Inventor: Erwin Bichler, Hall, Austria

[73] Assignee: Isosport Verbundbauteile Gesellschaft m.b.H., Austria

[21] Appl. No.: 635,975

[22] PCT Filed: Sep. 14, 1995

[86] PCT No.: PCT/AT95/00181

§ 371 Date: May 8, 1996

§ 102(e) Date: May 8, 1996

[87] PCT Pub. No.: WO96/08378

PCT Pub. Date: Mar. 21, 1996

[30] Foreign Application Priority Data

Sep. 15, 1994 [AT] Austria ..... 1768/94

[51] Int. Cl.[6] ..... B41F 23/08

[52] U.S. Cl. ..... 101/487; 156/244.11; 156/277

[58] Field of Search ..... 101/487; 156/277, 156/244.11, 244.27, 387, 583.1

[56] References Cited

U.S. PATENT DOCUMENTS

| | | | |
|---|---|---|---|
| 3,860,388 | 1/1975 | Haigh | 8/2.5 |
| 4,059,471 | 11/1977 | Haigh | 156/244 |
| 4,202,663 | 5/1980 | Haigh et al. | 8/471 |
| 4,462,852 | 7/1984 | Custor | 156/231 |
| 4,465,728 | 8/1984 | Haigh et al. | 428/156 |
| 4,505,975 | 3/1985 | Majima | 428/336 |
| 5,019,202 | 5/1991 | Kawahata et al. | 156/277 |
| 5,522,317 | 6/1996 | Hale et al. | 101/488 |
| 5,580,410 | 12/1996 | Johnston | 156/277 |

FOREIGN PATENT DOCUMENTS

| | | | |
|---|---|---|---|
| 1560778 | 12/1969 | Germany | 156/244.27 |
| 64282 | 6/1978 | Japan | 156/277 |
| 57-46877 | 3/1982 | Japan . | |
| 7-256752 | 10/1995 | Japan . | |
| 8-90740 | 4/1996 | Japan . | |
| 7302988 | 4/1974 | Netherlands | 101/487 |
| 542042 | 11/1973 | Switzerland . | |

*Primary Examiner*—Edgar S. Burr
*Assistant Examiner*—Daniel J. Colilla
*Attorney, Agent, or Firm*—Bacon & Thomas

[57] ABSTRACT

A process is disclosed for transfer printing thermoplastic materials with thermal diffusion inks. An image is transferred in a heatable press from a paper substrate colored with thermal diffusion inks onto an intermittently moved, fiber-containing carrier material into which the thermal diffusion inks can at first be sublimated then diffused. This fiber-containing carrier material provided with thermal diffusion inks is then transported into the gap between the calender rollers, where it is continuously brought into contact with a thermoplastic melt at an increased temperature so that the thermal diffusion inks penetrate into the thermoplastic melt and at the same time a composite strip made of the fiber-containing carrier material and the thermoplastic melt is formed. The products obtained by this process are suitable for producing a decorative layer on parts of skis or snowboards and on composite materials made of fiber-reinforced plastics.

9 Claims, 2 Drawing Sheets

PROCESS FOR PRINTING THERMOPLASTIC MATERIALS

BACKGROUND OF THE INVENTION

The invention relates to a process for printing thermoplastic materials with thermodiffusion dyes by transfer printing as well as the advantageous use of the product manufactured in this manner.

DESCRIPTION OF RELATED ART

It is known from DE-OS 2 731 121 that thermoplastic materials such as polyethylene can be printed by bringing the side of the polyethylene body which is to be printed under the influence of heat, and the melting effect caused thereby, into contact with a print carrier such as a paper substrate provided with thermodiffusion dyes. The printing of the decoration from the paper carrier onto the polyethylene body occurs at temperatures of 160° to 220° C., and the thermodiffusion dyes are first sublimated and then diffused into the thermoplastic material. With this process, however, the decorations printed on the thermoplastic material have blurred border zones, since the dyes migrate (bleed) in the polyethylene. This leads, especially under UV-ray influence, to a loss of color brightness or to the total loss of the decoration. Furthermore, great thermal tensions are liberated through the melting of the surface to be printed, and this does not permit the printing of relatively thin-walled objects, for example, strip-shaped objects such as ski linings, without a previous preparation for obtaining a balance of the inner tensions.

In this manner, an extreme tension decay occurs in the area of the border line between the molten side to be printed and the underside which is still in solid condition, and this leads to a warping of the printed lining during cooling. The melting in the case of previously treated ski-lining materials, that is, sharpened and gas-blazed ski-lining materials, causes a further deterioration of the mechanical properties already obtained, such as the pull force.

SUMMARY OF THE INVENTION

The present invention has, therefore, as its object to provide a process of the kind described above which allows bright contour-sharp, distortion-free prints without causing any rejection problems or deteriorated mechanical properties after the color transfer. The invention proposes a process for printing thermoplastic materials with thermodiffusion dyes by transfer pressure, wherein a print picture is produced by means of a paper substrate provided with thermodiffusion dyes which are sublimable at first and then diffusible into an intermittently moving carrier material containing fibers, and wherein this fiber-containing carrier material with the thermodiffusion dyes is continuously brought into contact with a thermoplastic melt through a calender roller gap in such a manner that the thermodiffusion dyes penetrate into the thermoplastic material and, at the same time, form a strip-shaped composite consisting of the fiber-containing carrier material and the thermoplastic material. With the process according to the invention, a bright contour-sharp print is generated on the thermoplastic material which is also color-stable with respect to UV rays, partially due to the penetration depth of the thermodiffusion dyes into the thermoplastic material. The printed thermoplastic material also has a high shape stability as well as especially good mechanical properties partially due to the fiber-containing carrier material.

Other advantages of the invention are caused by the fact that a fiber fabric, weave, or fleece is used as fiber-containing carrier material. The fibers in the carrier material are artificial and/or natural fibers, whereby the artificial fibers are made of polyester and/or polyamide and the natural fibers are cotton fibers. By taking these measures, no thermal shrinking occurs in the fiber-containing carrier material up to 200° C.

The invention is further characterized in that the fiber-containing carrier material is provided with an adhesive means on one or both surface sides that can be a hot melt adhesive film.

A further advantage of the invention consists in that polyethylene or polyamide is used as thermoplastic material.

The invention further relates to the use of a thermoplastic material printed with thermodiffusion dyes for manufacturing a decoration lining for ski or snowboard parts as well as for manufacturing a decoration layer on plastic-fiber attachment materials.

DESCRIPTION OF THE FIGURES OF DRAWINGS

The invention is further explained with respect to FIGS. 1 and 2 as well as with respect to the embodiments.

DETAILED DESCRIPTION OF THE PREFERRED EMBODIMENT

Figure 1:
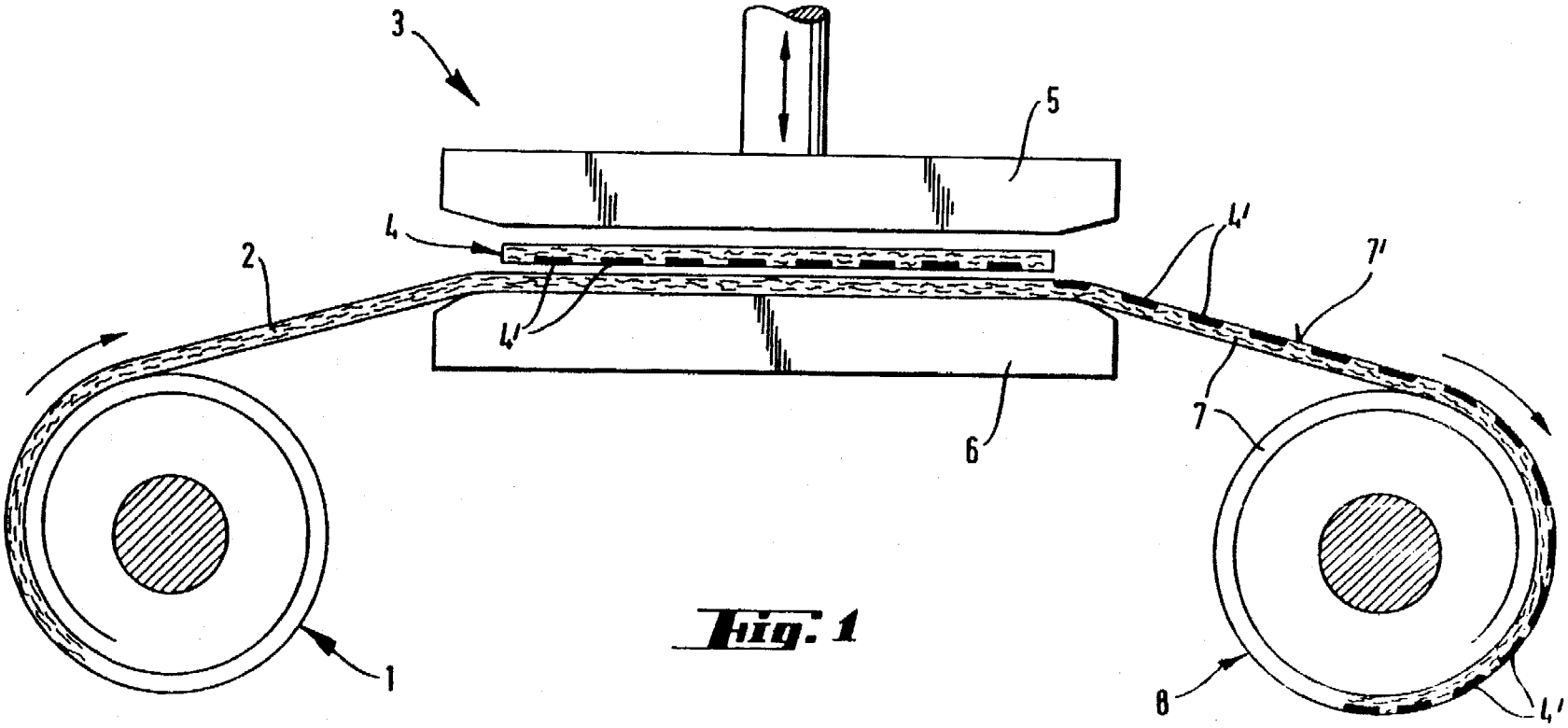
FIG. 1 shows a schematic of an apparatus and the process for printing with a paper substrate provided with thermodiffusion dyes on the fiber-containing carrier material.
Figure 2:
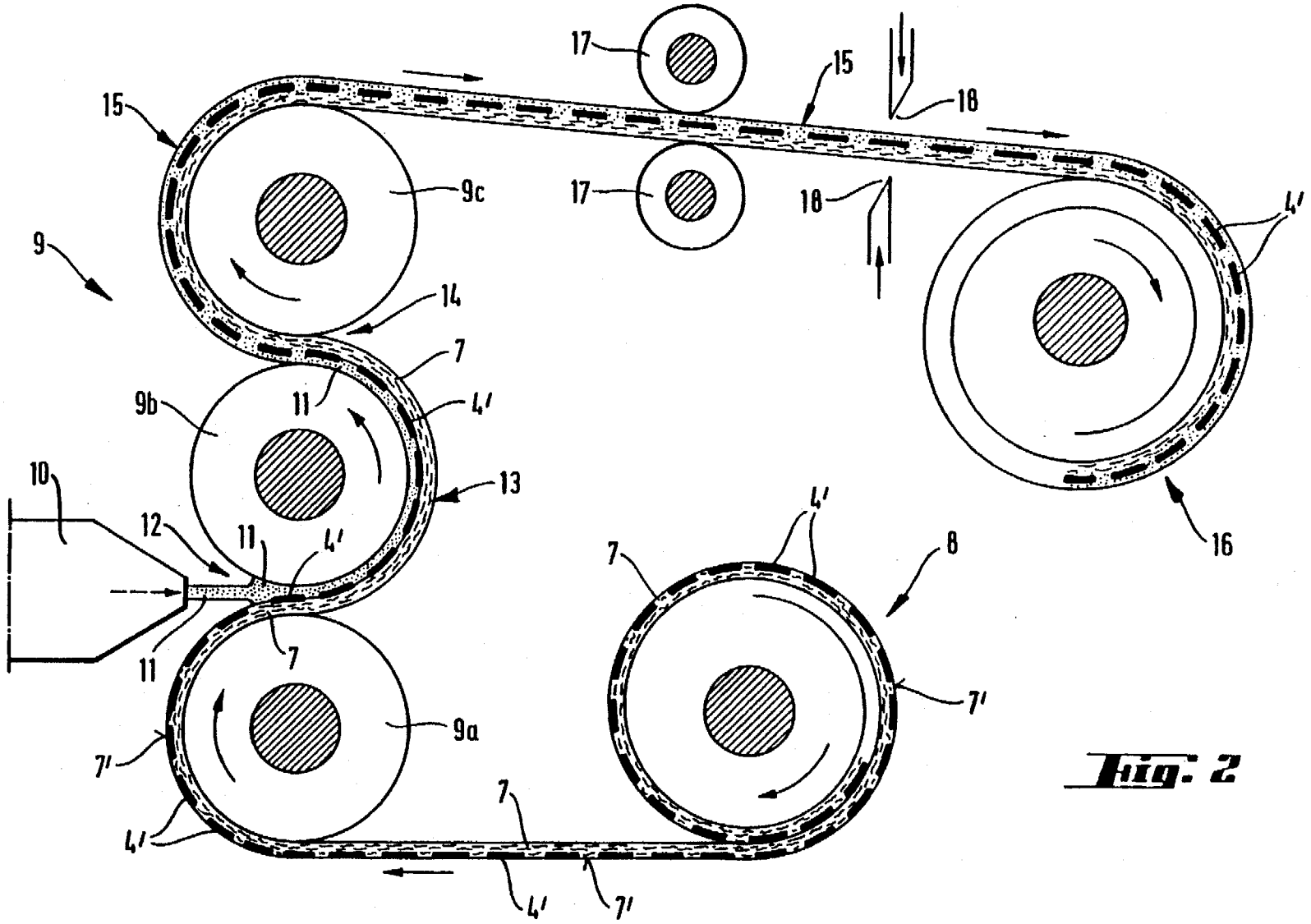
FIG. 2 shows a schematic of an apparatus and the process for forming a strip-shaped composite consisting of the fiber-containing carrier material and the thermoplastic material where the thermodiffusion dyes penetrate into the thermoplastic material.

The process according to the invention will be further explained with respect to the following embodiments as well as the description according to FIGS. 1 and 2.

According to FIG. 1, the fiber-containing carrier material 2 which, for example, can be a polyester fleece, is guided from the storage roll 1 into a heatable press 3. The carrier material has a needed width that is advantageous for its further use, such as the usual width of skis. Furthermore, it can be provided with a melt adhesive means on one or both surface sides. The fiber-containing carrier material 2 can be eased into the heatable press 3 partially by hand with a paper 4 provided with thermodiffusion dyes 4'. The length of the paper depends on the further intended use; it can correspond, for example, to the usual length of a ski. Additionally, the press 3 can be closed and heated to approximately 190° C. The time that the carrier material stays in the press can be from 30 to 210 seconds. The print pressure amounts to 80 to 85 bar. Because of the high temperatures in the heatable press, the thermodiffusion dyes 4' are sublimated in such a way that—due to the pressing pressure of the press plates 5, 6—the printing of the decoration 4' of the paper 4 occurs on the carrier material 2. The fiber-containing carrier material 7 provided on the decoration side 7' provided with the thermodiffusion dyes 4' is rolled about the roll 8 and can be stored or conveyed to the next process step.

This further use takes place according to FIG. 2 in that the storage roll 8 is placed ahead of a three-roll calender 9, whereby the fiber-containing carrier material 7 with the decoration side 7' provided with transfer pressure colors 4' is guided to the calender roller **9*a* heated to a temperature of 128° to 130° C. The decoration side 7' of the fiber-containing carrier material 7 with the thermodiffusion dyes 4' faces away from the calender roller 9***a*. At the same time, a thermoplastic melt 11 coming out of the extruder nozzle 10 is guided into the roller gap 12 created between the calender rollers 9*a* and 9*b* so that the substrate material 7 provided with the thermodiffusion dyes 4' and the thermoplastic melt 11 can come into contact. A composite 13 consisting of the fiber-containing carrier 7 and the thermoplastic material 11 is formed due to the higher temperature existing in the roller gap 12 and the print pressure generated by the calender rollers 9*a* and 9*b* and the transfer pressure colors 4' have already mostly been sublimated and have penetrated into the thermoplastic material 11. Polyethylene, for example, can be used as thermoplastic material 11, but it can also be a thermoplastic mixture of polymers of different structure. Further, and as a consequence of this, the composite 13 is guided to the roller gap 14 of the calender roller 9*c* created between the calender rollers 9*b* and 9*c* so that the calender rollers 9*b* and 9*c* can generate, on the one hand, an adhesive composite 13 consisting of the thermoplastic material 11 and the fiber-containing carrier material 7 by means of the temperature held at a constant 60° to 70° C. and the impression pressure generated in this way, and, on the other hand, the thermodiffusion dyes can be completely sublimated through the temperature, which is held constant, and can penetrate into the thermoplastic material 11. The penetration depth amounts to 0.1 to 0.2 mm. Further, the composite 13 is shaped and cooled down simultaneously by means of the temperature gradients formed between the calender roller 9*a* and the roller 9*b*. In this way, a thermoplastic material strip 15 printed with the thermodiffusion dyes 4' is manufactured and brings out the decoration with satisfactory contour sharpness and additionally shows improved mechanical properties due to the measure of using fiber-containing carrier material. The decorated thermoplastic material strip 15 can, additionally, be guided via the transport roller pair 17 to the storage roll 16 and, if necessary, can be trimmed with the cross cutter 18 for manufacturing individual articles.

The thermoplastic material strip decorated with thermodiffusion dyes manufactured according to the invention can be used for manufacturing a decoration layer on ski or snowboard parts and technical composites such as fiber combinations impregnated with epoxy resin as well as thermoplastic resins reinforced with fibers. The thermoplastic material strip can be attached to each decorated part by the usual adhesive techniques.

I claim:

1. Process for printing thermoplastic materials with thermodiffusion dyes by transfer printing comprising a) producing in a heatable press a printed picture on an intermittently moving fiber-containing carrier material by picture transfer from a paper carrier provided with thermodiffusion dyes which are first sublimable and then diffusible and b) guiding the fiber-containing carrier material provided with the thermodiffusion dyes into a calender roller gap at elevated temperature and bringing it continuously in contact with a thermoplastic material in such a manner that the thermodiffusion dyes penetrate into the thermoplastic material and, at the same time, create a strip-shaped composite consisting of the fiber-containing carrier material and the printed thermoplastic material.

2. Process according to claim 1 wherein the fiber-containing material is a material selected from the group consisting of a fiber fabric, weave, or fleece.

3. Process according to claim 2 wherein the fibers in the carrier material are selected from the group consisting of artificial fibers, natural fibers and mixtures thereof.

4. Process according to claim 3 wherein the artificial fibers are selected from the group consisting of polyester polyamide and mixtures thereof.

5. Process according to claim 3 wherein the natural fibers are cotton fibers.

6. Process according to claim 1 wherein polyethylene is used as the thermoplastic material.

7. Process according to claim 1 wherein polyamide is used as the thermoplastic material.

8. A thermoplastic material printed with thermodiffusion dyes manufactured according to claim 1 for manufacturing a decorative layer on ski or snowboard parts.

9. A thermoplastic material printed with thermodiffusion dyes manufactured according to claim 1 for manufacturing a decorative layer on a fiber reinforced plastic compound.

* * * * *